US006928689B2

(12) United States Patent
Dove

(10) Patent No.: US 6,928,689 B2
(45) Date of Patent: Aug. 16, 2005

(54) ROLLER CAGE ASSEMBLY

(76) Inventor: Michael J. Dove, 24115 Lindley St., Mission Viejo, CA (US) 92691

( * ) Notice: Subject to any disclaimer, the term of this patent is extended or adjusted under 35 U.S.C. 154(b) by 394 days.

(21) Appl. No.: 10/293,229

(22) Filed: Nov. 13, 2002

(65) Prior Publication Data

US 2003/0188395 A1 Oct. 9, 2003

Related U.S. Application Data

(63) Continuation-in-part of application No. 10/276,533, filed as application No. PCT/US02/11057 on Apr. 9, 2002, now Pat. No. 6,851,155.

(51) Int. Cl.[7] ..... B05C 17/02
(52) U.S. Cl. ..... 15/230.11; 492/13; 492/19
(58) Field of Search ..... 15/230.11; 492/13, 492/16–20

(56) References Cited

U.S. PATENT DOCUMENTS

| | | | | |
|---|---|---|---|---|
| 2,970,366 A | | 2/1961 | Gill | 492/19 |
| 3,115,659 A | | 12/1963 | Church | 15/230 |
| 3,228,087 A | | 1/1966 | Stoddart et al. | 492/19 |
| 3,274,637 A | | 9/1966 | Schulze | 401/208 |
| 3,447,184 A | | 6/1969 | McGinley | 15/230.11 |
| 3,711,887 A | | 1/1973 | Chapman | 15/230.11 |
| 3,745,624 A | | 7/1973 | Newman | 492/19 |
| 3,877,123 A | | 4/1975 | Pharris | 492/19 |
| 3,986,226 A | | 10/1976 | Roe et al. | 15/230.11 |
| 4,237,575 A | | 12/1980 | Mlachnik | 15/230.11 |
| 4,295,241 A | * | 10/1981 | Woolcock | 15/230.11 |
| 4,316,301 A | | 2/1982 | Smith et al. | 15/230.11 |
| 4,332,067 A | | 6/1982 | Pearce | 492/19 |
| D269,650 S | | 7/1983 | Allison | D4/122 |
| D293,860 S | | 1/1988 | Smith | D4/122 |
| D305,080 S | | 12/1989 | Morgan et al. | D4/122 |
| 4,897,893 A | | 2/1990 | Barker | 15/230.11 |
| 4,985,959 A | | 1/1991 | Lieberman et al. | 15/230.11 |
| D323,246 S | | 1/1992 | Best et al. | D4/122 |
| 5,090,084 A | | 2/1992 | De Guzman | 15/230.11 |
| 5,210,899 A | | 5/1993 | Goldstein et al. | 15/230.11 |
| 5,345,648 A | | 9/1994 | Graves | 15/230.11 |
| 5,490,303 A | | 2/1996 | Graves | 15/230.11 |
| D376,911 S | | 12/1996 | Zigelboim et al. | D4/122 |
| 5,594,971 A | | 1/1997 | Nelson | 15/230.11 |
| 5,619,769 A | | 4/1997 | Hutt | 15/230.11 |

FOREIGN PATENT DOCUMENTS

| | | | |
|---|---|---|---|
| DE | 3606939 | * | 9/1987 |
| DE | 4030884 | * | 4/1992 |
| DE | 4217979 | * | 12/1993 |
| DK | 113343 | | 3/1969 |
| EP | 389357 | | 9/1990 |
| FR | 1402540 | | 5/1965 |

* cited by examiner

*Primary Examiner*—Mark Spisich

(57) ABSTRACT

A roller cage assembly for use with a support rod is described. The roller cage assembly has a roller sleeve, a pair of end hub members, and a tube for use with a support rod. Each end hub member has an inner hub, an outer hub, a cavity, and a keeper. Each cavity receives and allows rotational movement of a corresponding keeper. Each cavity has a slightly reduced outer aperture defined by an annular tab to facilitate rotational movement of the keeper. Each keeper has a passage for receiving the support rod, an expandable gap for securing the support rod, and slip ridges to facilitate rotational movement of the keeper. Each keeper also typically has a joined slit membrane for maintaining a substantially constant degree of tension on the support rod. The tube is connected between the inner hub of each end hub member, and the roller sleeve is connected between the outer hub of each end hub member. The roller sleeve, each end hub member, and the tube form an integral unit and are arranged to define a sealed inner cavity, whereby liquid transfer into the inner cavity is substantially prevented.

16 Claims, 5 Drawing Sheets

ROLLER CAGE ASSEMBLY

This application is a continuation-in-part of application Ser. No. 10/276,533, filed 13 Nov. 2002 and now U.S. Pat. No. 6,851,155, which is a national stage application of International Application No. PCT/US02/11057, filed 9 Apr. 2002.

The contents of each of the aforementioned applications, and each U.S. Patent and other reference, if any, cited in this application, are hereby incorporated herein by reference.

FIELD OF INVENTION

The present invention relates generally to a roller cage assembly. More particularly, the present invention relates to a paint roller cage assembly that forms a sealed inner cavity whereby liquid contamination of the inner roller cavity is substantially prevented. End hub members are adapted to facilitate rotational movement of the paint roller cage assembly during its intended use.

BACKGROUND OF INVENTION

Liquid applicators such as paint rollers have come into widespread use due to their ability to apply coatings, usually paint, economically and quickly. Typically, known paint roller assemblies consist of a support handle with rod integrally connected or coupled to a support structure designed to hold a cylindrical cover. Various designs include wooden cores or spindles and cage-like support frames. Generally, each roller assembly includes end support members or bearing-like structures that provide rotational movement of the paint roller assembly relative to the support handle/rod. Paint or other liquid is applied to the cylindrical cover and the paint is applied to a surface.

Operation of known paint roller assemblies results in the roller assemblies becoming increasingly harder to roll as the roller assemblies become loaded with paint. Typically, paint intrusion will occur in the inner cavity, i.e., interior space generally defined as being between the end support members and the cover, or bearing structures of the roller assembly. For example, the cage-like support frame with compression fitted cover, after repeated uses, is particularly susceptible to paint intrusion to the inner cavity, causing the roller assembly to become heavy and the bearings to become loaded with paint and paint residues. The cage-like support frame is extremely difficult to clean because of the many tiny crevices formed by the cage wires. This problem can be exacerbated by painters who submerge the roller assembly into a container of paint at the end of a workday to avoid the time-consuming task of cleaning the roller assembly prior to the paint job being completed.

Although one known roller assembly as described in U.S. Pat. No. 3,711,887, issued Jan. 23, 1973 to Chapman, attempts to reduce paint intrusion into the inner cavity by the addition of a tube press-fitted over bearing sleeves, bearing structures remain exposed and fail due to paint contamination.

U.S. Pat. No. 4,985,959, issued Jan. 22, 1991 to Lieberman et al, employs an end support member consisting of a split tube positioned in a chamber. The design of the end support member does not facilitate optimal rotational movement of the paint roller assembly relative to the bearing.

All known paint roller assemblies have disadvantages: (1) they are difficult to assemble and disassemble when cleaning or replacing worn parts; (2) end hub members and/or bearing design do not facilitate optimal rotational movement of the paint roller assembly relative to the bearing; (3) bearings fail due to paint contamination; and (4) they become heavy and cumbersome to use as the inner cavity becomes loaded with paint.

Accordingly, there is a need for a roller cage assembly that is less susceptible to paint degradation, provides greater ease of rotation, is easier to clean, and is more economical to produce than known devices.

SUMMARY OF INVENTION

The present invention describes a roller cage assembly that is less susceptible to paint degradation, provides greater ease of rotation, is easier to clean, and is more economical to produce than known devices. The roller cage assembly includes a roller sleeve, a pair of end hub members, and a tube, all for use with a support rod. Each end hub member has an inner hub, an outer hub, a cavity, and a keeper. Each cavity receives and allows rotational movement of a corresponding keeper.

Each keeper has a passage for receiving the support rod, an expandable gap for securing the support rod, and slip ridges to facilitate rotational movement of the keeper within a cavity. The slip ridges provide a smaller surface contact area than known devices. Reduced contact area results in less frictional drag upon the rotational movement of the keeper within the cavity. Typically, each keeper also includes a joined slit membrane. The diameter of the keeper occupied by the joined slit membrane remains substantially constant thus maintaining a substantially constant degree of tension on the support rod.

Each cavity has a slightly reduced outer aperture defined by an L-shaped annular tab to facilitate rotational movement of a corresponding keeper. Similar to the slip ridges, the annular tab provides a limited surface area for contact with the keeper during operation of the roller cage assembly. Surface area contact is reduced to approximately half that of typical devices, resulting in less frictional drag upon the rotational movement of the keeper within the cavity. In addition to the aforementioned attribute, the annular tab acts to reduce the diameter of the outer aperture. The reduced diameter of the outer aperture inhibits liquid intrusion into the inner cavity of the end hub member. Therefore, use of slip ridges in combination with the annular tab facilitates optimal rotational movement of the end hub member and roller sleeve relative to the keeper.

The tube is connected between the inner hub of each end hub member, and the roller sleeve is connected between the outer hub of each end hub member. The roller sleeve, each end hub member, and the tube are arranged to define a sealed inner cavity, whereby liquid transfer into the inner cavity is substantially prevented. The sealed inner cavity excludes paint or other liquids from entering and becoming trapped inside the roller cage assembly, which would cause the roller cage assembly to become heavy and cumbersome to manipulate during use. When connected, the roller sleeve, each end hub member, and the tube, together form an integral unit requiring no assembly and/or disassembly of parts for the end user. Typically, the end hub member is constructed of a plastic material. Being substantially similar, the end hub members may be produced using a single plastic mold thereby significantly simplifying the manufacturing process and conserving economic resources.

The slip ridges, joined slit membrane, annular tab, sealed inner cavity, substantially similar end hub members, and other structural elements provide for a roller cage assembly that is less susceptible to paint degradation, provides greater ease of rotation, is easier to clean, and is more economical to produce than known devices.

DETAILED DESCRIPTION

The present invention describes a roller cage assembly capable of applying liquids to a surface. The roller cage assembly is less susceptible to paint degradation, provides greater ease of rotation, is easier to clean, and is more economical to produce than known devices. The roller cage assembly includes a roller sleeve, a pair of end hub members, and a tube, all for use with a support rod. Each end hub member has an inner hub, an outer hub, a cavity, and a keeper within the cavity. Each cavity receives and allows rotational movement of a corresponding keeper. Each cavity has a slightly reduced outer aperture defined by an L-shaped annular tab to facilitate rotational movement of its keeper. Each keeper has a passage for receiving a support rod, an expandable gap for securing the support rod, and slip ridges to facilitate rotational movement of the keeper within the cavity. The keepers also typically include a joined slit membrane for maintaining a substantially constant degree of tension on the support rod. The tube is connected between the inner hub of each end hub member, and the roller sleeve is connected between the outer hub of each end hub member. The roller sleeve, each end hub member, and the tube, all form an integral unit, and are arranged to define a sealed inner cavity, whereby liquid transfer into the inner cavity is substantially prevented.

Typically, the opposing end hub members and keepers are substantially similar. Thus for ease of describing the present invention, it will be understood that except for differences specifically described herein, the description of one end hub member and keeper applies equally to the opposing end hub member and keeper. On the other hand, FIG. 5 and FIG. 6 have been included to illustrate each end hub member and keeper with some distinctively named parts. It will be understood that the roller cage assembly shown in FIG. 5 and FIG. 6 discloses the same elements cooperating in the same manner to produce the same results, as the end hub member described in FIGS. 1–4 and FIGS. 7–12 of the present invention.

Figure 3:
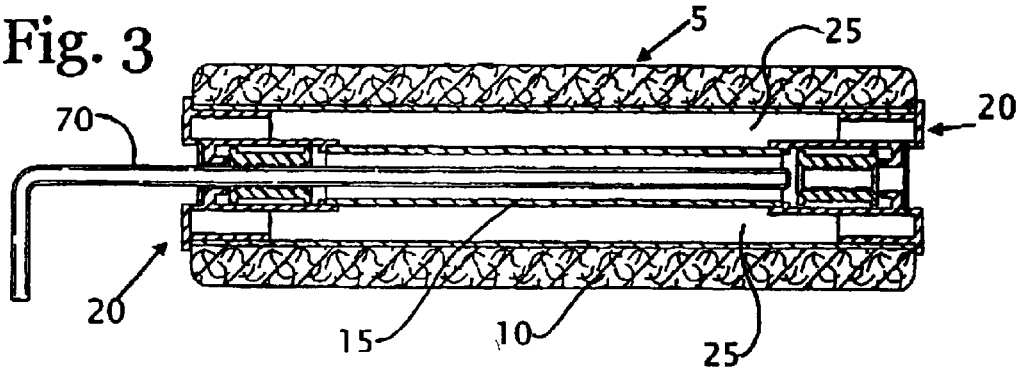
FIG. 3 is a sectional view of a roller cage assembly in accordance with the present invention, showing the sealed inner cavity, and the support rod partially received by each end hub member and the tube.

Referring now to FIG. 3, a sectional view of the roller cage assembly in accordance with the present invention, showing the sealed inner cavity, and the support rod partially received by each end hub member and tube, is shown. The roller cage assembly 5 includes a roller sleeve 10, a tube 15, and a pair of end hub members 20 for use with a support rod 70. Typically, the roller sleeve 10 is cylindrical in shape to which is applied fabric, sponge, or other similar material conventionally employed for liquid application. Generally, the fabric is applied to the roller sleeve with an adhesive material such as glue. Materials used in construction of the tube 15, each end hub member 20, and keepers 45 include plastic and variations thereof, such as polyvinyl chloride (PVC) or any similarly characterized lightweight material. As described herein, the roller sleeve 10, each end hub member 20, and the tube 15, all form an integral unit that is arranged to define an substantially annular sealed inner cavity 25, whereby liquid transfer into the inner cavity 25 is substantially prevented.

Figure 1:
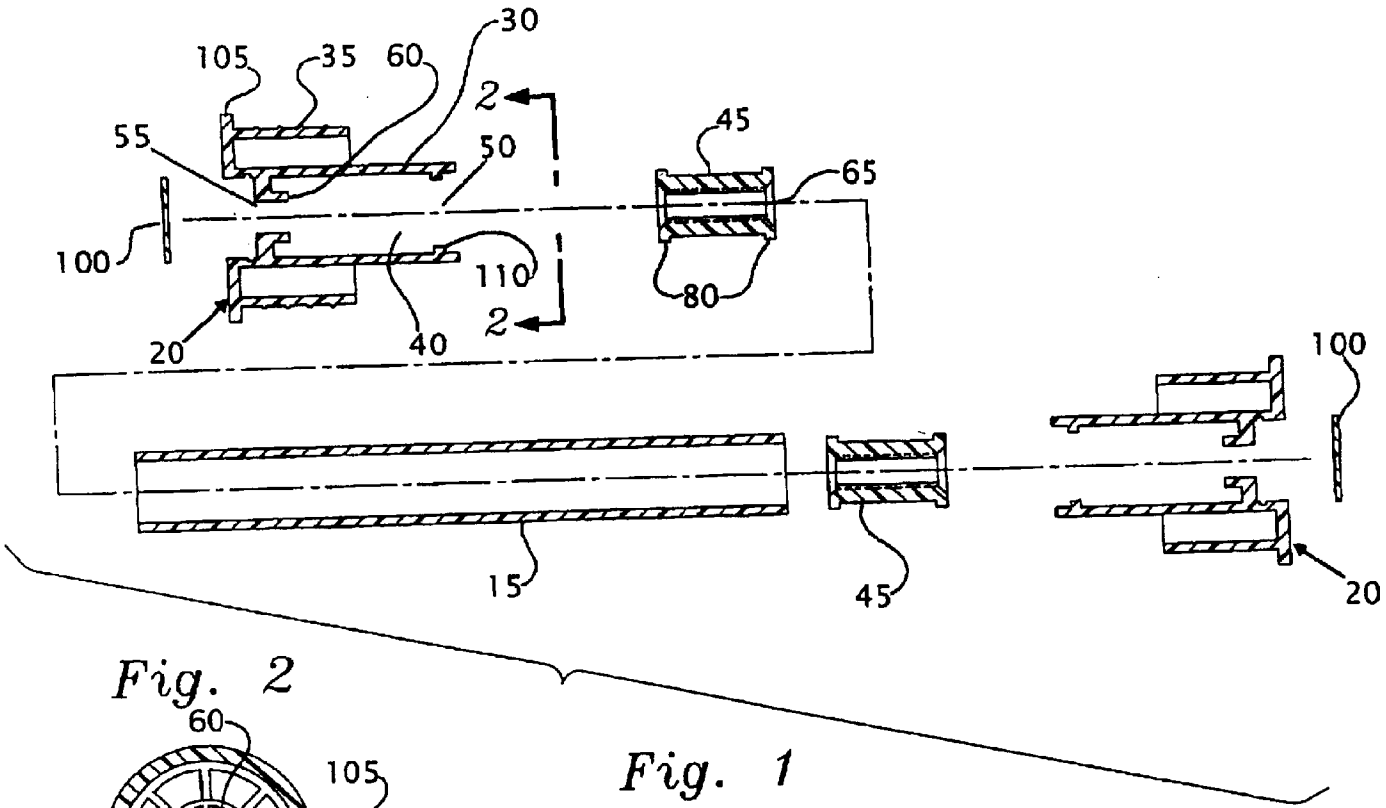
FIG. 1 is an exploded sectional view of a roller cage assembly in accordance with the present invention, without the roller sleeve.
Figure 2:
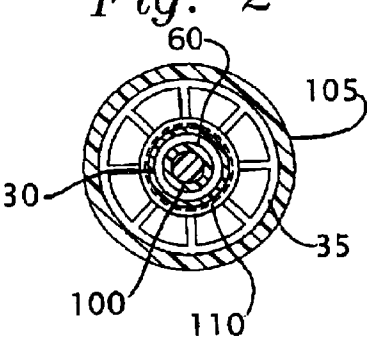
FIG. 2 is a sectional view of a roller cage assembly taken along line 2—2 shown in FIG. 1, without the roller sleeve.

More detail of the roller cage assembly can be seen in FIG. 1, which shows an exploded sectional view of a roller cage assembly in accordance with the present invention, without the roller sleeve. Each end hub member 20 includes an inner hub 30, an outer hub 35, a cavity 40, and a corresponding keeper 45. An inner hub 30 and an outer hub 35, having a greater diameter than the diameter of the inner hub 30, generally define the end hub member 20. The diameter of the outer hub 35 is adapted to receive the roller sleeve 10 of a diameter that permits frictional engagement between the outer hub 35 and the roller sleeve 10. The diameter of inner hub 30 is slightly greater than the diameter of the tube 15. A general relationship between the various components of the roller cage assembly 5 is shown in FIG. 2, a sectional view of the roller cage assembly 5 taken along line 2—2 shown in FIG. 1.

The arrangement of the outer hub 35 and inner hub 30 forms a cavity 40. The cavity 40 receives and allows rotational movement of the keeper 45. The cavity 40 has an inner aperture 50 and an outer aperture 55. The outer aperture 55 is defined by an L-shaped annular tab 60 and has a diameter slightly less than the diameter of the inner aperture 50. The diameter of the outer aperture 55 is slightly greater than the diameter of an industry standard support rod 70 used by painters or other individuals in a similar job. As described herein, the annular tab 60 facilitates rotational movement of the keeper 45 within the cavity 40.

Figure 11:
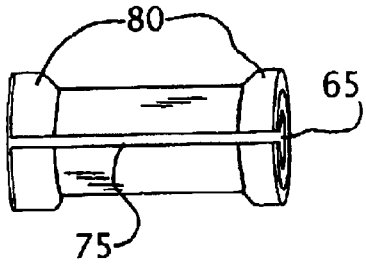
FIG. 11 is a side elevational view of a first embodiment of a keeper in accordance with the present invention.
Figure 12:
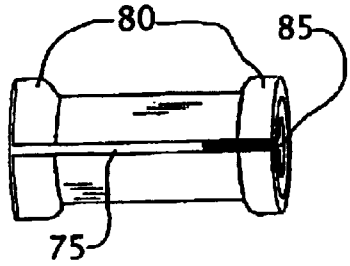
FIG. 12 is a side elevational view of a second embodiment of a keeper, having a joined slit membrane.

The keeper 45 includes a passage 65 for receiving the support rod 70. As shown in FIG. 11 and FIG. 12, the keeper 45 further includes an expandable gap 75 for securing the support rod 70, slip ridges 80 to facilitate rotational movement of the keeper 45 within the cavity 40, and a joined slit membrane 85 for maintaining a substantially constant degree of tension of the support rod 70.

The keeper 45 is placed into cavity 40 through the inner aperture 50. In a relaxed state, the inner diameter of the passage 65 is smaller than the outside diameter of the support rod 70. The passage 65 of the keeper 45 is caused to expand upon receiving the support rod 70. Expansion of the passage 65 creates a force to frictionally retain the support rod 70. Generally, over time and with extended use, the keeper 45 will fatigue, thus tension on the support rod 70 will gradually decrease. Typically, the keeper 45 will include a joined slit membrane 85. The joined slit membrane 85 extends partially along one end of the keeper 45, vitiating a portion of the expandable gap 75. Use of the joined slit membrane 85 provides an area of the keeper 45 where the inner diameter of the passage 65 remains basically constant overtime, thus maintaining a substantially constant degree of tension on the support rod 70.

Expansion of the passage 65 of the keeper 45 is sufficient to allow the support rod 70 to pass therethrough. The passage 65 does expand enough to restrict rotational movement of the keeper 45 within the cavity 40. Slip ridges 80, located along the keeper 45, facilitate rotational movement of the keeper 45 within the cavity 40. Slip ridges 80 are protrusions typically located at opposite ends of the keeper 45. During operation of the roller cage assembly 5, typically only the slip ridges 80 make contact with the cavity 40. The slip ridges 80 provide a smaller surface contact area than known devices. Reduced contact area results in less frictional drag upon the rotational movement of the keeper 45 within the cavity 40. Annular tab 60, defining the outer aperture 55 of the cavity 40, further facilitates rotational movement of the keeper 45.

Similar to the slip ridges 80, the L-shaped annular tab 60 provides a limited surface area for contact with the keeper 45 during operation of the roller cage assembly 5. Surface area contact is reduced to approximately half that of known devices, resulting in less frictional drag upon the rotational movement of the keeper 45. In addition to the aforementioned attribute, the annular tab 60 reduces the diameter of the outer aperture 55. The reduced diameter of the outer aperture 55 inhibits liquid intrusion into the cavity 40 of the end hub member 20. Therefore, use of slip ridges 80 in combination with the annular tab 60 facilitates optimal rotational movement of the end hub member 20 and roller sleeve 10 relative to the keeper 45. The improved ease of rotation of roller cage assembly 5 enables painters to apply a smooth even layer of paint to the desired surface to be painted.

Figure 4:
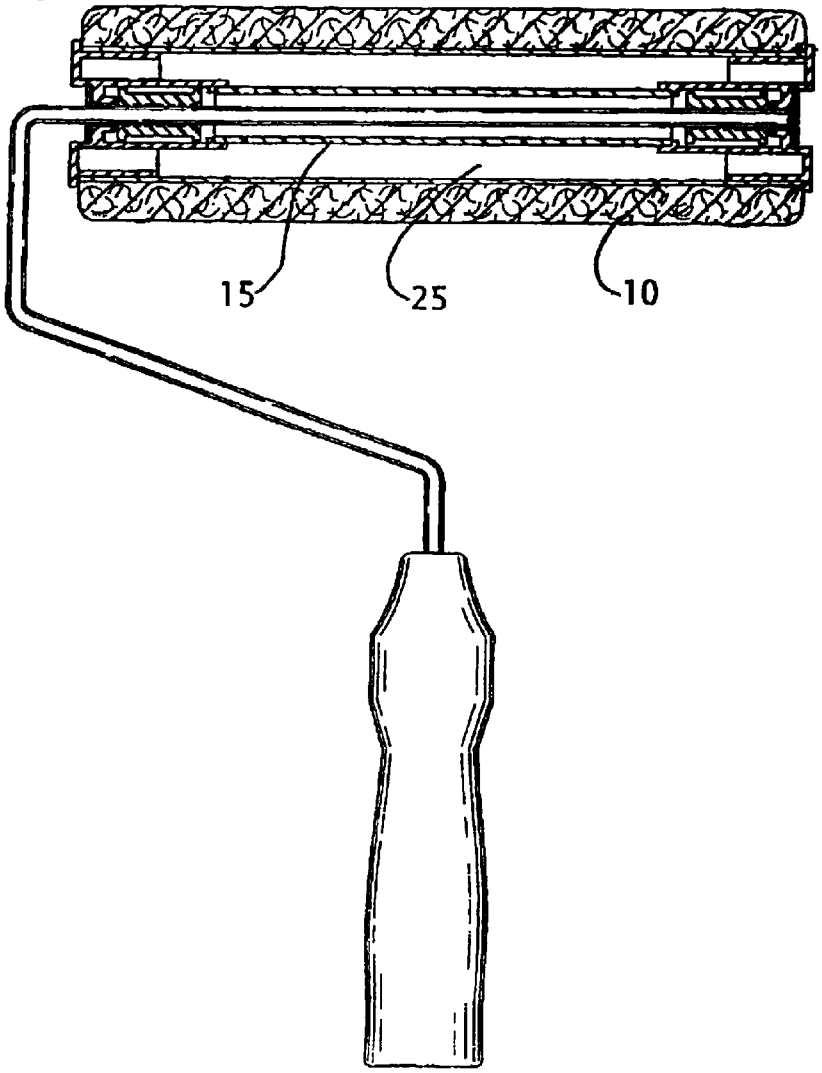
FIG. 4 is a sectional view of a roller cage assembly in accordance with the present invention, showing the support rod fully received by each end hub member and the tube.

Turning now to FIG. 4, a sectional view of the roller cage assembly in accordance with the present invention, showing the support rod fully received by each hub member and the tube, is shown. The tube 15 is connected between the inner hub 30 of each end hub member 20. Typically, connection of the tube 15 to the inner hub 30 of each end hub member 20 is accomplished by a compression fit of the tube 15 into the inner aperture 50. The application of an adhesive, such as glue, to the tube 15 or inner surface of inner hub 30 (forming the inner aperture 50) prior to insertion of the tube 15 into the inner aperture 50, permanently secures the components together and provides a barrier, whereby liquid transfer into the inner cavity 25 is substantially prevented. An annular tube stop 10 provides a stopping point for the insertion of the tube 15 into the inner aperture 50, thus prohibiting insertion of the tube 15 into the cavity 40 occupied by the keeper 45. The tube 15 may be of any desired length but is typically of a length such that together with each end hub member 20 the roller cage assembly 5 can accommodate a 7-inch, 9-inch or 12-inch roller sleeve 10. As shown in FIG. 4, each end hub member 20 having an inner aperture 50 and outer aperture 55, and the tube 15 having a hollow core, are adapted to receive the support rod 70.

The roller sleeve 10 is connected between the outer hub 35 of each end hub member 20. Typically, connection of roller sleeve 10 between the outer hub 35 of each end hub member 20 is accomplished by a compression fit between the roller sleeve 10 and the outer hub 35. The application of an adhesive, such as glue, to the roller sleeve 10 or outer hub 35 prior to insertion of the outer hub 35 into the roller sleeve 10 permanently secures the components together and provides a barrier, whereby liquid transfer into the inner cavity 25 is substantially prevented. The outer hub 35 may include an annular flange 105 for engaging the end of the roller sleeve 10. The annular flange 105 provides a stopping point such that the outer hub 35 can only be inserted into the roller sleeve 10 a predetermined distance.

Figure 8:
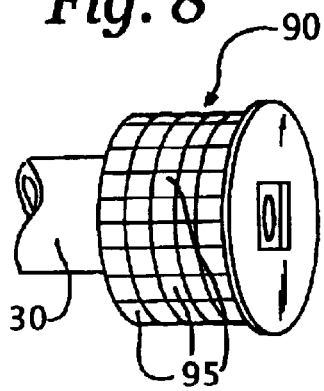
FIG. 8 is a perspective view of the end hub member shown in FIG. 7, with a wire embossed negative.
Figure 10:
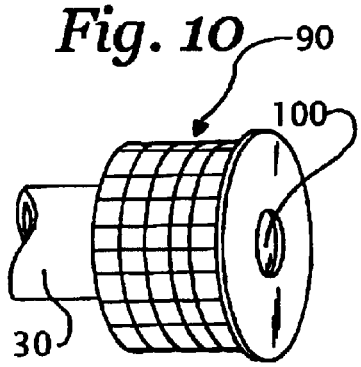
FIG. 10 is a perspective view of the hub member shown in FIG. 9, with a wire embossed negative.

The outer hub 35 may include a wire-embossed negative 90 for receiving an adhesive such as glue, as shown in FIG. 8 and FIG. 10. The wire-embossed negative 90 provides a plurality of individualized receptors 95 for the adhesive. The individualized receptors 95 facilitate a substantially even distribution of the adhesive over the surface of the outer hub 35. The pattern, generally checkerboard in appearance, of individualized receptors ensures proper distribution of the adhesive in the manufacturing process to enable a positive seal between the interior surface of the roller sleeve 10 and the exterior surface of the outer hub 35. The seal provides a barrier, whereby liquid transfer into the inner cavity 25 is substantially prevented. A cap 100 may be secured to one end hub member 20 to substantially prevent liquid transfer into the tube 15.

Typically, the connection between the tube 15 and the inner hub 30 of each end hub member 20 is facilitated by glue. In addition, typically, the connection between the roller sleeve 10 and the outer hub 35 of each end hub member 20 is facilitated by glue. Thus, when connected, the roller sleeve 10, each end hub member 20, and the tube 15, together form an integral unit requiring no assembly and/or disassembly of parts by the end user. Furthermore, the roller sleeve 10, each end hub member 20, and the tube 15, all are connected and arranged to define a sealed inner cavity 25, whereby liquid transfer into the inner cavity 25 is substantially prevented. Specifically, the sealed inner cavity 25 may be thought of as an annular sealed inner cavity 25 because the sealed inner cavity 25 surrounds in a ring-like fashion the tube 15 and the inner hub 30 of each end hub member 20, as shown in FIG. 3. Paint or other liquids cannot enter the sealed inner cavity 25, and thus cannot became trapped inside the roller cage assembly 5, which would cause the roller cage assembly 5 to become heavy and cumbersome to manipulate during use. Typically, the end hub member 20 is constructed of a plastic type material. Being substantially similar, each end hub member 20 may be produced using a single plastic mold thereby significantly simplifying the manufacturing process. Furthermore, the uniform construction of the each end hub member 20 permits the support rod 70 or cap 100 to be inserted into and received by either end hub member 20.

Figure 7:
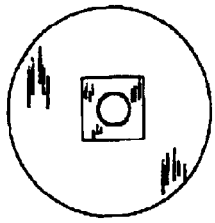
FIG. 7 is a front planar view of a first embodiment of an end hub member in accordance with the present invention.
Figure 9:
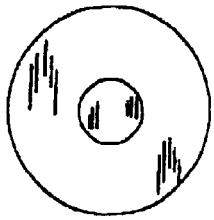
FIG. 9 is a front planar view of a second embodiment of an end hub member in accordance with the present invention.
Figure 13:
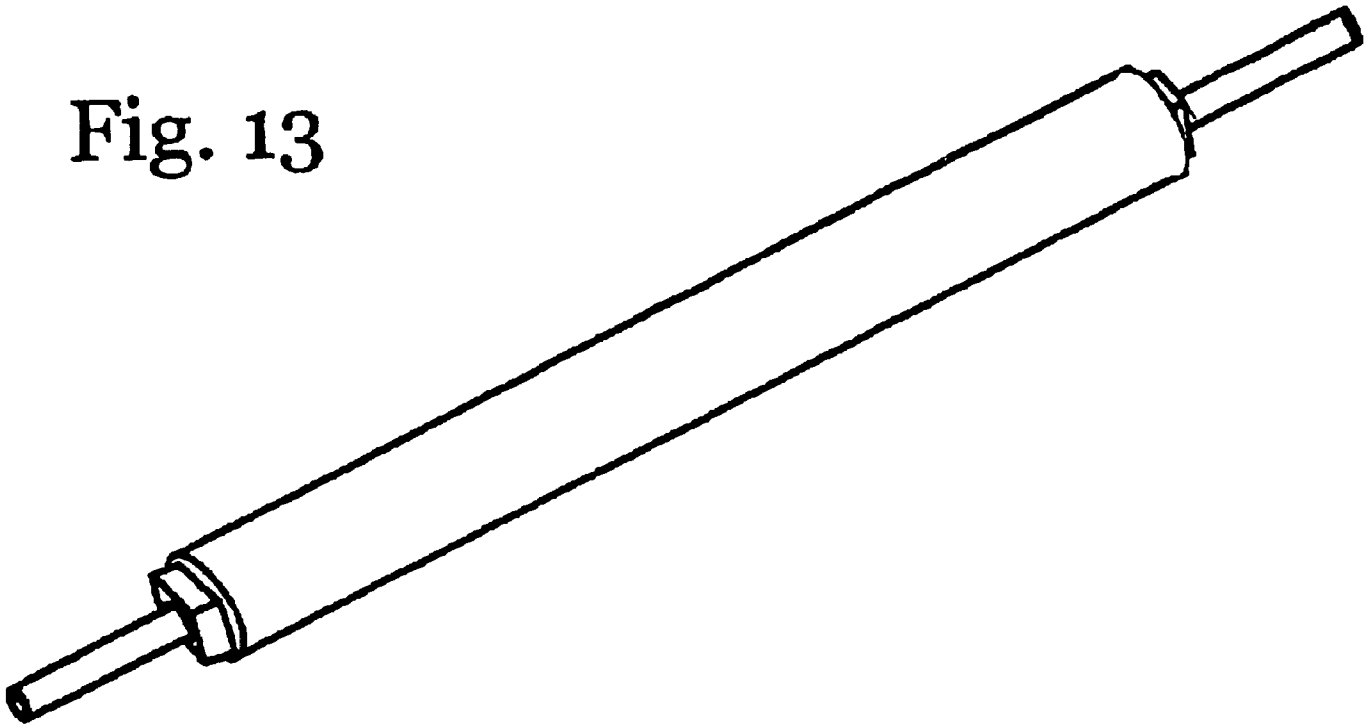
FIG. 13 is a perspective view of a tool for use with a roller cage assembly of the present invention.

Referring now to FIGS. 7 and 9, front planar views of embodiments of the end hub member in accordance with the present invention, are shown. The area surrounding the outer aperture 55 may be characterized by a variety of shapes. The area may be substantially square, as shown in FIG. 7. Alternatively, the area may be substantially circular, as shown in FIG. 9. Likewise, one end hub member 20 may have a distinctive shape that is different from the other end hub member 20. Typically, the shape of the area surrounding the outer aperture 55 is adapted to receive a similarly shaped cap 100. The shape of the area surrounding the outer aperture 55 may be adapted to receive a tool, as shown in FIG. 13, which facilitates cleaning of the roller cage assembly 5. The tool will typically have ends that correspond in diameter to industry standard support rods for insertion into the outer aperture 55 of the end hub member 20, and a center section adapted for use with a spinner (a device well-known in the art) or other similar device.

Figure 6:
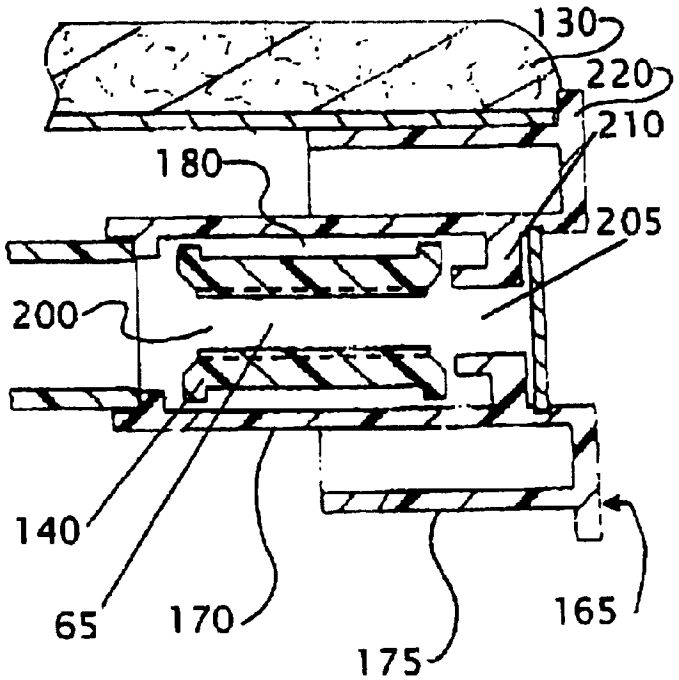
FIG. 6 is a sectional view of a secondary hub assembly in accordance with the present invention.
Figure 5:
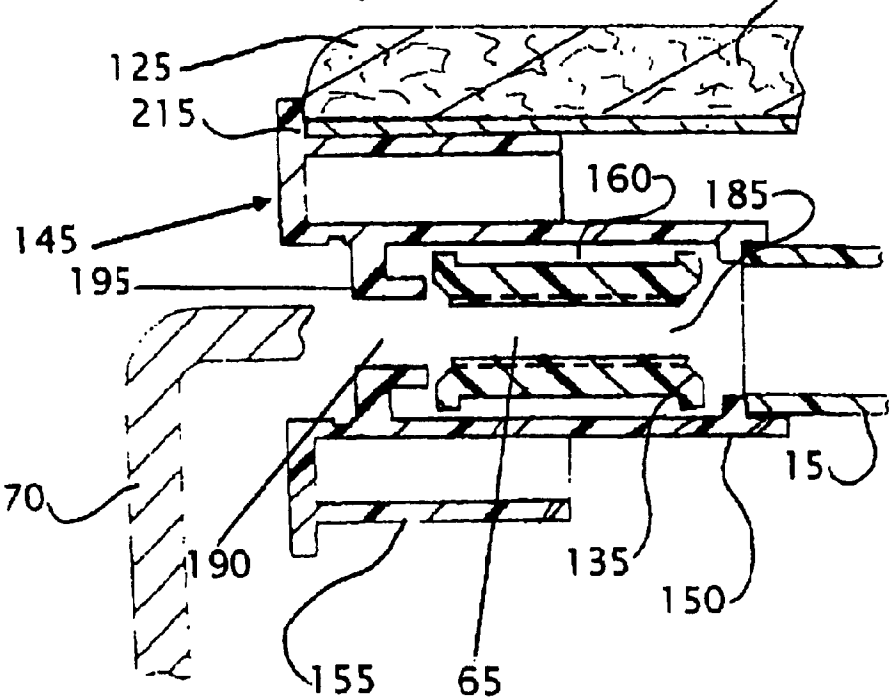
FIG. 5 is a sectional view of a primary hub assembly in accordance with the present invention.

Turning now to FIG. 5 and FIG. 6, sectional views of the primary hub assembly and the secondary hub assembly in accordance with the present invention, are shown. FIG. 5 and FIG. 6 are shown as two separate figures representing opposite sides of the roller cage assembly 5. The roller cage assembly 5 has a roller sleeve 10 having a first end 125 and a second end 130; a primary keeper 135 having a passage 65 for receiving the support rod 70, and has an expandable gap 75 (see FIG. 11) for securing the support rod 70; a secondary keeper 140 having a passage 65 for receiving the support rod 70, and has an expandable gap 75 (see FIG. 11) for securing the support rod 70; a primary hub 145 having an inner hub 150, an outer hub 155, and a cavity 160; a secondary hub 165 having an inner hub 170, an outer hub 175, and a cavity 180; and a tube 15 connected between the primary inner hub 150 and the secondary inner hub 170.

The cavity 160 of the primary hub 145 receives and allows rotational movement of the primary keeper 135. The cavity 160 of the primary hub 145 has an inner aperture 185 and an outer aperture 190. The outer aperture 190 is defined by a primary annular tab 195 and has a diameter slightly less than the diameter of the inner aperture 185. The primary annular tab 195 facilitates rotational movement of the primary keeper 135. The primary keeper 135 has slip ridges 80 (see FIG. 11) to facilitate rotational movement of the primary keeper 135 within the cavity 160 of the primary hub 145.

The cavity 180 of the secondary hub 165 receives and allows rotational movement of the secondary keeper 140. The cavity 180 of the secondary hub 165 has an inner aperture 200 and an outer aperture 205. The outer aperture 205 is defined by a secondary annular tab 210 and is slightly reduced than the inner aperture 200. The secondary annular tab 210 facilitates rotational movement of the secondary keeper 140. The secondary keeper 140 has slip ridges 80 (see FIG. 11) to facilitate rotational movement of the secondary keeper 140 within the cavity 180 of the secondary hub 165.

The outer hub 155 of the primary hub 145 is connected to the first end 125 of the roller sleeve 10; the outer hub 175 of the secondary hub 165 is connected to the second end 130 of the roller sleeve 10; and the roller sleeve 10, the primary hub 145, the secondary hub 165, and the tube 15, all are arranged to define a sealed inner cavity 25 (see FIG. 4), whereby liquid transfer into the inner cavity 25 is substantially prevented.

The primary keeper 135 may have a joined slit membrane 85 (see FIG. 11) for maintaining a substantially constant degree of tension on the support rod 70, and the secondary keeper 140 may have a joined slit membrane 85 (see FIG. 11) for maintaining a substantially constant degree of tension on the support rod 70. The outer hub 155 of the primary hub 145 may have a wire-embossed negative 90 (see FIGS. 8 and 10) for receiving an adhesive such as glue, and the outer hub 175 of the secondary hub 165 may have a wire-embossed negative 90 (see FIGS. 8 and 10) for receiving an adhesive such as glue. Typically, the connection between the first end 125 of the roller sleeve 10 and the outer hub 155 of the primary hub 145 is facilitated by glue. Similarly, the connection between the second end 130 of the roller sleeve 10 and the outer hub 175 of the secondary hub 165 is typically facilitated by glue.

The primary hub 145, the tube 15, and the secondary hub 165 are adapted to receive the support rod 70. The roller cage assembly 5 may further have a cap 100 (see FIG. 1) secured to the secondary hub 165 to substantially prevent liquid transfer into the tube 15. The primary hub 145 and the secondary hub 165 are substantially similar. Typically, the primary hub 145 has a primary annular flange 215 for engaging the first end 125 of the roller sleeve 10. Similarly, the secondary hub 165 typically has a secondary annular flange 220 for engaging the second end 130 of the roller sleeve 10.

While certain embodiments are illustrated in the drawings and are described herein, including preferred embodiments, it will be apparent to those skilled in the art that the specific embodiments described herein may be modified without departing from the inventive concepts described.

What is claimed is:

1. A roller case assembly for use with a support rod comprising:

a roller sleeve having a first end and a second end;

a primary keeper having a passage for receiving the support rod, and having an expandable gap for securing the support rod;

a secondary keeper having a passage for receiving the support rod, and having an expandable gap for securing the support rod;

a primary hub having an inner hub, an outer hub, and a cavity;

a secondary hub having an inner hub, an outer hub, and a cavity; and a tube connected between the primary inner hub and the secondary inner hub;

wherein the cavity of the primary hub receives and allows rotational movement of the primary keeper, and has an inner aperture and an outer aperture, said outer aperture defined by a primary annular tab having a diameter slightly less than the diameter of the inner aperture, said primary annular tab facilitating rotational movement of the primary keeper;

wherein the primary keeper has slip ridges to facilitate rotational movement of said primary keeper within the cavity of the primary hub;

wherein the cavity of the secondary hub receives and allows rotational movement of the secondary keeper, and has an inner aperture and an outer aperture, said outer aperture defined by a secondary annular tab having a diameter slightly less than the diameter of the inner aperture, said secondary annular tab facilitating rotational movement of the secondary keeper;

wherein the secondary keeper has slip ridges to facilitate rotational movement of said secondary keeper within the cavity of the secondary hub;

wherein the outer hub of the primary hub is connected to the first end of the roller sleeve;

wherein the outer hub of the secondary hub is connected to the second end of the roller sleeve; and wherein the primary keeper has a joined slit membrane for maintaining a substantially constant degree of tension on the support rod, and the secondary keeper has a joined slit membrane for maintaining a substantially constant degree of tension on the support rod.

2. The roller cage assembly of claim 1, wherein the outer hub of the primary hub has a wire-embossed negative for receiving an adhesive, and wherein the outer hub of the secondary hub has a wire-embossed negative for receiving an adhesive.

3. The roller cage assembly of claim 2, wherein the connection between the first end of the roller sleeve and the outer hub of the primary hub is facilitated by glue, and wherein the connection between the second end of the roller sleeve and the outer hub of the secondary hub is facilitated by glue.

4. The roller cage assembly of claim 1, wherein the primary hub, the tube, and the secondary hub are adapted to receive the support rod.

5. The roller cage assembly of claim 1, further comprising a cap secured to the secondary hub to substantially prevent liquid transfer into the tube.

6. The roller cage assembly of claim 1, wherein the primary hub and the secondary hub are substantially similar.

7. The roller cage assembly of claim 1, wherein the primary hub has a primary annular flange for engaging the first end of the roller sleeve, and the secondary hub has a secondary annular flange for engaging the second end of the roller sleeve.

8. A roller cage assembly for use with a support rod comprising:

a roller sleeve having a first end and second end;

a primary keeper having a passage for receiving the rod, and having an expandable gap for securing the support rod;

a secondary keeper having a passage for receiving the rod, and having an expandable gap for securing the support rod;

a primary hub having an inner hub, an outer hub, and a cavity;

a secondary hub having an inner hub, an outer hub, and a cavity; and a tube connected between the primary inner hub and the secondary inner hub;

wherein the cavity of the primary hub receives and allows rotational movement of the primary keeper, and has an inner aperture and an outer aperture, said outer aperture having a diameter slightly less than the diameter of the inner aperture;

wherein the primary keeper has slip ridges to facilitate rotational movement of said primary keeper within the cavity of the primary hub;

wherein the cavity of the secondary hub receives and allows rotational movement of the secondary keeper, and has an inner aperture and an outer aperture, said outer aperture slightly less in diameter than the diameter of the inner aperture;

wherein the secondary keeper has slip ridges to facilitate rotational movement of said secondary keeper within the cavity of the secondary hub;

wherein the outer hub of the primary hub is connected to the first end of the roller sleeve;

wherein the outer hub of the secondary hub is connected to the second end of the roller sleeve;

wherein the roller sleeve, the primary hub, the secondary hub, and the tube are arranged to define a sealed inner cavity, whereby liquid transfer into the inner cavity is prevented; and wherein the primary keeper has a joined slit membrane for maintaining a substantially constant degree of tension on the rod, and the secondary keeper has a joined slit membrane for maintaining a substantially constant degree of tension on the rod.

9. The roller cage assembly of claim 8, wherein the outer hub of the primary hub has a wire-embossed negative for receiving an adhesive, and wherein the outer hub of the secondary hub has a wire-embossed negative for receiving an adhesive.

10. The roller cage assembly of claim 9, wherein the connection between the first end of the roller sleeve and the outer hub of the primary hub is facilitated by glue, and wherein the connection between the second end of the roller sleeve and the outer hub of the secondary hub is facilitated by glue.

11. A roller cage assembly for use with a support rod comprising:

a roller sleeve;

a tube; and a pair of end hub members, each said end hub member comprising:
an inner hub;
an outer hub;
a cavity; and
a keeper;

wherein each cavity receives and allows rotational movement of a corresponding keeper, each cavity having an inner aperture and an outer aperture, each outer aperture having a diameter slightly less than the diameter of the inner aperture;

wherein each keeper has: a passage for receiving the support rod; slip ridges to facilitate rotational movement of the keeper, and a joined slit membrane for maintaining a substantially constant degree of tension on the support rod; and wherein the roller sleeve, each end hub member, and the tube are arranged to define a sealed inner cavity, whereby liquid transfer into the inner cavity is substantially prevented.

12. The roller cage assembly of claim 11, wherein each end hub member has a wire-embossed negative for receiving an adhesive.

13. The roller cage assembly of claim 12, wherein connection of the roller sleeve between the inner hub of each end hub member is facilitated by glue.

14. The roller cage assembly of claim 11, further comprising a cap secured to one of the end hub members to substantially prevent liquid transfer into the tube.

15. The roller cage assembly of claim 11, wherein the roller sleeve, the tube, and the pair of end hub members form an integral unit.

16. The roller case assembly of claim 11, wherein the outer aperture of each cavity further includes an annular tab to facilitate rotational movement of the keeper.

* * * * *